US009793603B2

(12) United States Patent
Yan

(10) Patent No.: US 9,793,603 B2
(45) Date of Patent: Oct. 17, 2017

(54) MILLIMETER WAVE FREQUENCY DATA COMMUNICATION SYSTEMS

(71) Applicant: Hewlett-Packard Development Company, L.P., Houston, TX (US)

(72) Inventor: John Yan, Foster City, CA (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 142 days.

(21) Appl. No.: 13/929,249

(22) Filed: Jun. 27, 2013

(65) Prior Publication Data

US 2015/0002355 A1 Jan. 1, 2015

(51) Int. Cl.

| | |
|---|---|
| ***H01Q 1/52*** | (2006.01) |
| ***H01Q 1/22*** | (2006.01) |
| *H01Q 13/06* | (2006.01) |
| *H01P 3/12* | (2006.01) |
| *H01P 5/12* | (2006.01) |
| *H01Q 9/04* | (2006.01) |
| *H01Q 9/06* | (2006.01) |

(52) U.S. Cl.

CPC ..... *H01Q 1/52* (2013.01); *H01Q 1/2283* (2013.01); *H01P 3/121* (2013.01); *H01P 5/12* (2013.01); *H01Q 9/0407* (2013.01); *H01Q 9/065* (2013.01); *H01Q 13/06* (2013.01)

(58) Field of Classification Search

CPC ..... H01Q 1/52

USPC ..... 343/793

See application file for complete search history.

(56) References Cited

U.S. PATENT DOCUMENTS

| | | | | |
|---|---|---|---|---|
| 6,960,970 | B2 * | 11/2005 | Elco | H01P 1/16 333/239 |
| 7,271,680 | B2 * | 9/2007 | Hall | H01Q 9/0471 333/136 |
| 7,983,519 | B2 | 7/2011 | Kamins et al. | |
| 8,202,012 | B2 | 6/2012 | Stewart et al. | |
| 2011/0199972 | A1 * | 8/2011 | Warke | H01Q 3/26 370/328 |

(Continued)

FOREIGN PATENT DOCUMENTS

| | | | |
|---|---|---|---|
| EP | 1 361 672 | A1 | 11/2003 |
| WO | WO-2012/159933 | A2 | 11/2012 |

OTHER PUBLICATIONS

D. Shim, et al., "Paths to Terahertz CMOS Integrated Circuits," in IEEE Custom Integrated Circuits Conf., San Jose, CA, Sep. 2009, pp. 657-664, IEEE.

(Continued)

*Primary Examiner* — Dameon E Levi
*Assistant Examiner* — Walter Davis
(74) *Attorney, Agent, or Firm* — Hewlett Packard Enterprise Patent Department

(57) ABSTRACT

A first module and a second module are formed on a complementary metal-oxide-semiconductor (CMOS) chip substrate. The first module is to serialize and de-serialize a data signal. The second module is to up-convert and down-convert the data signal to and from the first module. An antenna is coupled to the second module and integrated onto the CMOS chip substrate. The antenna is coupleable to a hollow metal waveguide (HMWG). The first and second modules are arranged for proximity to the antenna to avoid substantially degrading the data signal at millimeter wave frequencies in migrating the data signal between the first module and the antenna.

13 Claims, 7 Drawing Sheets

(56) References Cited

U.S. PATENT DOCUMENTS

| | | | |
|---|---|---|---|
| 2012/0175535 | A1 | 7/2012 | Chen et al. |
| 2012/0256796 | A1 | 10/2012 | Leiba |

OTHER PUBLICATIONS

David M. Pozar, "Microwave Engineering," 2012, pp. 1-756, Fourth Edition, John Wiley & Sons, Inc., United Kingdom, Available at: <electron frba utn edu ar/~jcecconi/Bibliografia/Ocuitos/Libros/Microwave Engineering Da.

Eunyoung Seok et al., "Progress and Challenges Towards Terahertz CMOS Integrated Circuits," IEEE Journal of Solid-State Circuits, vol. 45, No. 8, Aug. 2010, pp. 1554-1564, IEEE.

J. D. Albrecht, et al., "THz Electronics Projects at DARPA : Transistors, TMICs and Amplifiers," in IEEE MTT-S Int. Microw. Symp. Dig., May 2010, pp. 1118-1121, IEEE.

Lee, Thomas H. The design of CMOS radio-frequency integrated circuits. Cambridge university press, 2004.

S.T. Nicholson et al., "A 1.2V, 140GHz Receiver with On-Die Antenna in 65nm CMOS," Jun. 2008, pp. 229-232, IEEE RFIC Symp., Atlanta, GA, IEEE, Available at: <http://www eecg toronto edu/~sorinv/papers/nicolson RF081065 pdf>.

Spartaco Caniggia and Francescaromana Maradei, "Signal Integrity and Radiated Emission of High-Speed Digital Systems," 2008, pp. 1-555, John Wiley & Sons Ltd United Kingdona Available at.

V. Radisic, et al., "220-GHz Solid-State Power Amplifier Modules," IEEE Journal of Solid-State Circuits, vol. 47, No. 10. Oct. 2012, pp. 2291-2297, IEEE.

Paul Rosenberg et al., "Low Cost, Injection Molded 120 Gbps Optical Backplane," Journal of Lightwave Technology, Feb. 15, 2012, pp. 590-596, vol. 30, No. 4, Available at: <ieeexplore.ieee.org/xpl/login.jsp?tp=&arnumber=5875787&url=http%3A%2F%2Fieeexplore.ieee.org%2Fxpls%2Fabs_all.jsp%3Farnumber%3D5875787>.

* cited by examiner

MILLIMETER WAVE FREQUENCY DATA COMMUNICATION SYSTEMS

BACKGROUND

Backplane architectures may involve optical links and/or traces patterned on printed circuit board (PCBs), to connect controllers for data transfers and other communication. PCB and/or optical backplane architectures may be associated with additional conversion steps, a need for intricate microelectromechanical system (MEMS) devices, and fragile, complicated and costly alignment techniques.

BRIEF DESCRIPTION OF THE DRAWINGS/FIGURES

DETAILED DESCRIPTION

A hollow waveguide may be used as a propagation medium for backplane architectures operating at millimeter (mm) wave frequencies. The backplane architecture may be driven by complementary metal-oxide semiconductor (CMOS) technologies to provide robust and low-cost construction and operation. Example systems may integrate relatively small waveguides with communications systems to form backplanes for mm frequency operation. In contrast to printed circuit board (PCB) propagation media, example mm wave frequency backplane systems provided herein do not suffer from dielectric loss. Additionally, in contrast to optical backplanes, example systems are not limited to needing electrical-optical-electrical (E/O/E) conversions, optical connector alignments, or delicate microelectromechanical systems (MEMS). Accordingly, example systems may be less expensive, and more compact to reduce distances between driver components and an antenna, to efficiently couple a greater proportion of functionally useful mm wave energy onto the antenna coupled to a waveguide/backplane, to minimize energy attenuation.

Figure 1:
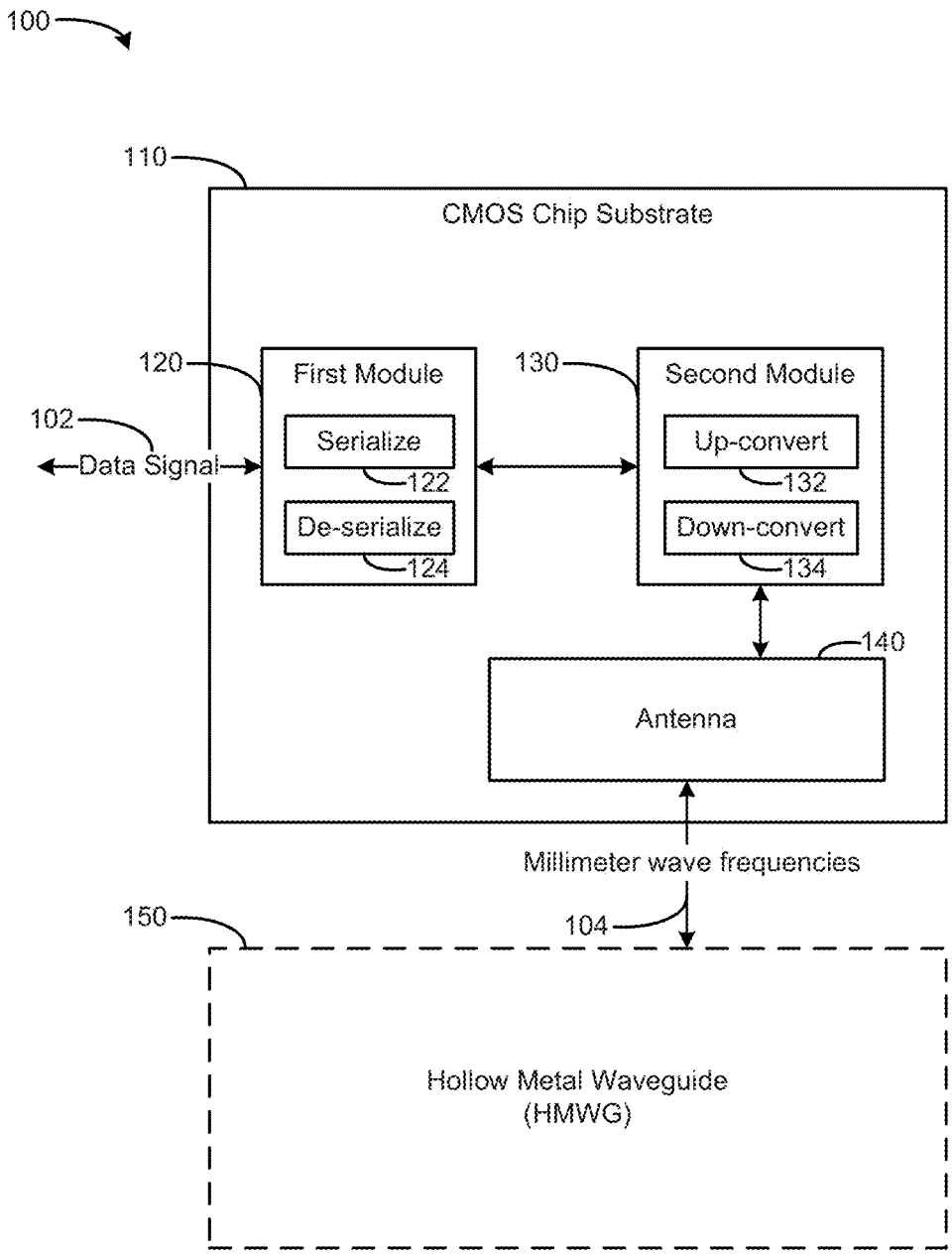
FIG. 1 is a block diagram of a system including a first module and a second module according to an example.

FIG. 1 is a block diagram of a system 100 including a first module 120 and a second module 130 according to an example. Complementary metal-oxide semiconductor (CMOS) chip substrate 110 is to interact with (e.g., receive and/or provide) a data signal 102. The first module 120 is to serialize 122 and de-serialize 124 data. Second module 130 is to up-convert 132 and down-convert 134 data. System 100 also includes antenna 140, to communicate with hollow metal waveguide (HMWG) 150 using millimeter (mm) wave frequencies 104.

System 100 may send and/or receive data signal 102 to and/or from the HMWG 150. In an example, system 100 may operate as a transmitter, as a receiver, and/or as a transceiver (e.g., switchable to send and receive). In a transmitter example, the CMOS chip substrate 110 may be a silicon (Si) substrate, the first module 120 may be a time domain multiplexed data serializer, and the second module 130 may be a mixer to up-convert data to millimeter wave frequencies. The antenna 140 may be an on-chip planar antenna, directly coupled to a network of hollow wave metallic waveguides 150. The HMWG 150 may form a backplane including two or more metal plates brought into intimate contact and including a plurality of channels. The backplane may include two or more bends, designed for fundamental transverse electric mode propagation at mm wave frequencies. Thus, the example CMOS technology transmitter may serialize data (consuming bandwidth=$f_{BF}$) at the first module 120, and the second module 130 subsequently may up-convert the data to $f_{RF}=f_{BF}+f_{IR}$. The up-converted data optionally may be fed into a driver (not shown, such as a power amplifier) to be radiated into a waveguide 150 via the on-chip antenna 140 operating at mm wave frequencies 104. Propagated data signals may be received by another system 100. For example, a receiver system including an on-chip planar antenna on a Si substrate, to amplify and subsequently downconvert the received data signal through a mixer to a baseband frequency, subsequently demultiplexed for further digital signal processing. Regarding the first module 120 and the second module 130, matching networks may be incorporated in the second module 130 and/or between the first and second modules 120, 130 to minimize reflections, as functional building blocks coupled to one another. These matching networks may be implemented using controlled transmission lines of different geometries or lumped circuit elements.

In the example system 100 serving as a transmitter, the first module 120 may be a serializer based on time division multiplexing to convert parallel data channels to a single data channel that can use more bandwidth ($f_{BF}$) than one of the parallel data channels. The second module 130 may be an up-converter to up-convert a single data channel to a fairly broadband signal that can occupy, e.g., approximately 20 GHz or more. Additional modules (not specifically shown) may be used, e.g., to feed the signal into a driver (e.g., a power amplifier) to be radiated into the waveguide 150 using an on-chip antenna 140 and operating at mm wave frequencies 104. In an alternate example, a bandpass filter may be used to filter undesired radiated energy and also act as a passive equalizer and matching network between a mixer module and a driver module. A driver module, if used, may include a series of inverters, scaled in increasing size, to amplify signal output to the antenna 140. Various additional modules such as these, and others, may be used in system 100.

In an example, system 100 may serve as a receiver implemented in CMOS technology to include antenna 140 to receive a data signal at mm wave frequencies 104 from the waveguide 150. The antenna 140 optionally may be coupled to a low noise amplifier (not shown, which may be included in and/or coupled to second module 130). Second module 130 may include a mixer to down-convert the data from the antenna 140. The first module 120 may receive the down-converted data, and may include a demultiplexer (deserializer), which may consist of a continuous time linear equalizer (CTLE) followed by a clock data recovery (CDR) circuit, digitally tunable equalizer followed by a serial-to-parallel converter, for further baseband processing of the down-converted data from the first module 120. The first module 120 may then provide the data signal 102.

Antenna 140 may be metal, including elemental metals (e.g., copper), as well as metal alloys (e.g., copper alloys, metals passivated with gold to suppress oxidation, and so on). The antenna 140 may be formed directly on the substrate 110, and does not need to be formed on a separate PCB, or other package substrate, that would be separate from the substrate 110. By supporting design compactness associated with mm wave frequencies 104, system 100 enables the use of small antenna 140 directly on-chip in close proximity to other on-chip components. Antenna 140 may be a dipole antenna, including a spiral antenna or other classes of dipoles that may include differential antennas. Monopole and other patch antennas also are supported. Antenna 140 may be an on-chip planar antenna. Antenna 140 is to be easily integrated with CMOS processing in a Si substrate, for example. Thus, antenna 140 may avoid attenuation or other signal degradation and losses that would otherwise be associated with other antenna designs, e.g., designs that would need to migrate mm wave energy through distances that would cause degradation and attenuation/energy loss. Antenna 140 may be coupled to the waveguide 150, for efficient signal transfer to the waveguide 150.

The substrate 110 may be based on CMOS technology to provide a system 100 compatible with high operating frequencies, e.g., beyond 10 GHz. Further improvements are contemplated. For example, as lithography improves, and CMOS circuit metrology improves, system operating frequencies (e.g., max frequency $F_{max}$, and unity gain ($F_T$)) may further increase. An example system 100 may operate in mm wave frequencies, e.g., in excess of 30 GHz and even in excess of 300 GHz. Such high operating mm wave frequencies 104 enable system 100 to scale down in physical size for the feasible integration of an on-chip antenna 140 to be coupled to HMWG 150 which transmits data in excess of multiple gigabits. Thus, antenna 140 may be provided on-chip, without a need for a separate module/substrate to accommodate antenna 140. System 100 similarly avoids a need for a separate support chip for antenna 140, e.g., to drive a matching network provided on a separate printed circuit board (PCB) antenna or other separately provided antenna. System 100 does not need additional process technologies and methods that are different than CMOS technology, that would be incompatible with integration onto a single chip substrate 110 along with a serializer, mixer, and/or other components of system 100 (e.g., that may be needed for a separate driver that uses a plurality of mimics).

The operating frequencies of system 100 enable the antenna 140 to be shrunken to a size compatible with being integrated onto semiconductor (e.g., Si) substrate 110 with all other components of the system 100. Associated components are small and integrated onto the substrate 110, including modules 120, 130 (e.g., a serializer, mixer, driver, etc.) along with antenna 140. The on-die antenna 140 may enable system 100 to couple output directly from the substrate 110 onto the waveguide 150. System 100 may be fabricated on one substrate, and subsequently may be integrated with, and enjoy the benefits of, other CMOS process technologies such as digital signal processors (DSPs) amenable to fabrication on one substrate.

The system 100 may communicate data using mm wave frequencies 104, e.g., based on time domain multiplexing. System 100 may support communication protocols such as the common electrical interface (CEI) specification, 28 GIG interfaces (e.g., CEI-28G), InfiniBand, Fibre Channel, PCI Express, Serial ATA, and other interconnects. System 100 may support protocols that offer multicast operations as well as point-to-point bidirectional serial links, e.g., for connecting processors with high-speed peripherals such as disks. Various signaling rates are supporting, including the ability to bond together multiple links for additional throughput. Other standards may be supported, including those being developed such as CEI-56G having increased electrical lane data rates, CMOS Switch ASIC bandwidth, and front panel port density.

The coupling between antenna 140 and waveguide 150 may be described as a transition. Antenna 140 may transition to the waveguide 150 based on a radiation pattern of the antenna 140 that is amenable to a propagation mode of the waveguide 150. In an example, the waveguide 150 may be associated with a fundamental transverse electric propagation mode. Thus, antenna 140 may be placed around a cross-sectional middle or center of a rectangular waveguide 150, to excite the transverse electric mode of the waveguide 150.

Although the waveguide 150 is illustrated as separated by a distance from the substrate 110 and antenna 140, the waveguide 150 may over-encompass (e.g., overlap) the antenna 140, or vice-versa. For example, the antenna 140 may include a ledge where the antenna 140 is to overlap the waveguide 150. The waveguide 150 may be mechanically adhered to the substrate 110 (directly or indirectly, e.g., to a housing of the substrate 110). The CMOS chip substrate 110 may include ledges to accommodate features of the waveguide 150 to clasp onto the ledges of the substrate 110. The antenna 140 may be electrically coupled to the waveguide 150. The antenna 140 may be separated from the waveguide 150 by an air gap, while electrically coupled to the waveguide 150 based on compatible propagation modes between the antenna 140 and waveguide 150. A housing around the substrate 110, or other stabilizer, may insulate the antenna 140 from physically coming in contact with the waveguide 150.

Thus, examples of system 100 enable the use of hollow waveguides 150 as a propagation medium for backplane architectures operating at mm wave frequencies, driven by robust and low-cost CMOS technologies to transmit and/or receive data signals 102. Example architectures have advantages over a traditional PCB backplane propagation medium, in that there is no dielectric loss, resulting in examples having significantly less loss and allowing for longer distance backplane architectures. Example waveguide-based backplanes provide advantages over optical backplanes, avoiding a need for E/O/E conversions, optical connector alignments, and delicate (e.g., MEMS) devices. Radio heterodyne architectures may be employed, to up-convert baseband data to mm wave frequencies that are available to higher performing (e.g., nanoscale) CMOS systems 100. Tremendous data rates (e.g., over 40 GBs) may be transmitted over a serial channel associated with the waveguide 150, for long distances (e.g., over 20 inches) with low loss, that would be unachievable with traditional PCB-based backplane architectures. In an example system 100, a two meter backplane using standard protocols can be achieved easily. Moreover, the backplane 150 has excellent structural integrity due to its construction of metal, or rigid plastics with metallic coatings, which may be easily manufactured. As CMOS technologies improve, even higher $f_T$ (unity gain) is achievable and the hollow waveguide structure also may be further miniaturized, due to decreasing wavelengths of the mm wave frequencies 104, leading to improved performance (e.g., more data rate) per channel. As a result, examples provided herein may be used in multi-terabit backplanes.

Figure 2:
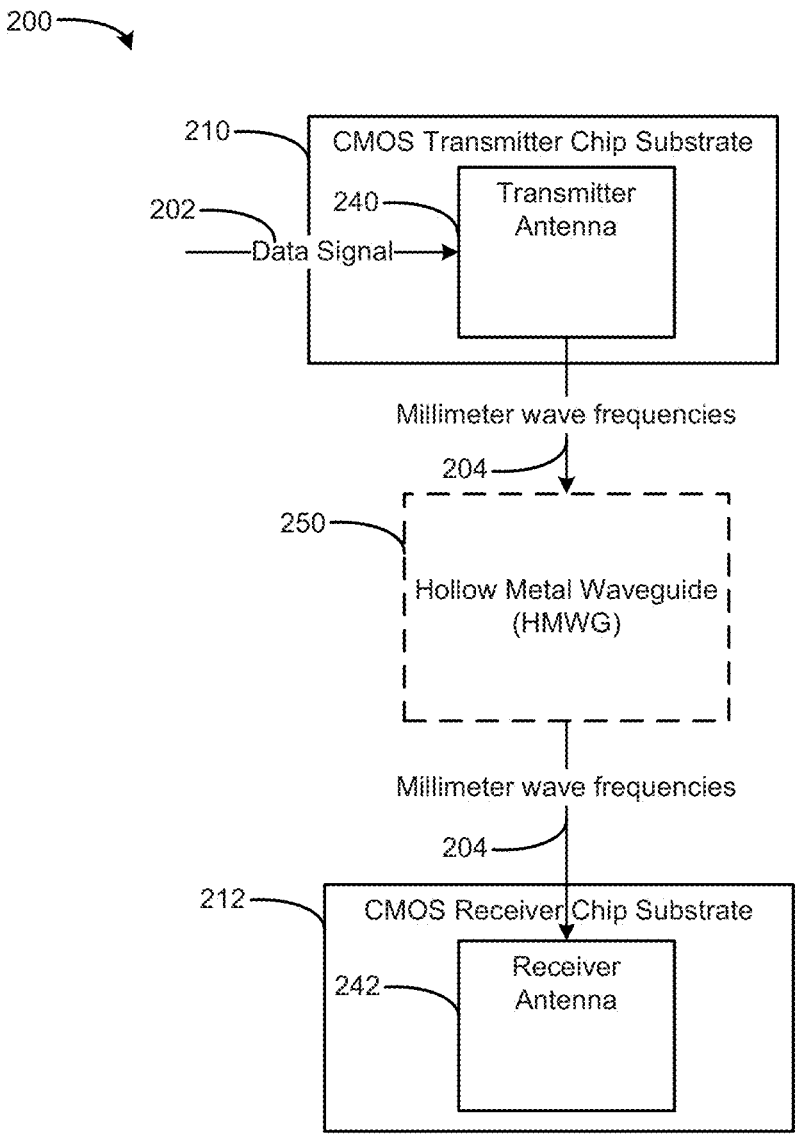
FIG. 2 is a block diagram of a system including a transmitter substrate and a receiver substrate according to an example.

FIG. 2 is a block diagram of a system 200 including a transmitter substrate 210 and a receiver substrate 212 according to an example. The CMOS transmitter chip substrate 210 is to receive data signal 202, and use transmitter antenna 240 to transmit mm wave frequencies 204 to HMWG 250. The CMOS receiver chip substrate 212 is to use receiver antenna 242 to receive mm wave frequencies 204 from the HMWG 250.

In an example, the transmitter substrate 210 and the receiver substrate 212 may be implemented based on the substrate 110 of FIG. 1. The transmitter-receiver system 200 may be used in a channel of a backplane. In an example, a first system 200 (transmitter-receiver) may form a channel of a backplane, and a complementary receiver-transmitter may be associated with that channel, for hi-directional data communication. Thus, a plurality of systems 200 may be incorporated into a plurality of channels, to form a network backplane.

System 200 also illustrates that a substrate 210, 212 may include components that do not need to perform all the functionality (e.g., for transmitting and receiving) as shown in FIG. 1. For example, a substrate may operate as transmit-only or receive-only, and include corresponding components such as antennas 240, 242. Thus, a substrate (such as substrate 110 of FIG. 1) may be optimized to perform transmit-only or receive-only functionality. In an example, transmitter substrate 210 may include a first module to serialize and a second module to up-convert, whereas receiver substrate 212 may include a first module to de-serialize and a second module to down-convert.

In an alternate example, system 200 may be based on multi-function substrates 210, 212, e.g., a substrate that is switchable to operate as a transmitter and/or receiver. Accordingly, a switchable substrate and its components may be designed and manufactured, and customized for operating as a transmitter substrate 210 or a receiver substrate 212. In an example, a substrate is switchable in the field between transmitting and receiving, as a transceiver. Thus, the transmitter substrate 210 may switch to function as a receiver substrate, and vice versa, in the field. A substrate may include multiple modules that may be selectively enabled or disabled to provide desired functionality as a transmitter and/or receiver. The substrates are amenable to coupling with the waveguide 250 based on mm wave frequencies 204, e.g., based on compatible propagation modes between the antennas 240, 242 and waveguide 250.

Figure 3A:
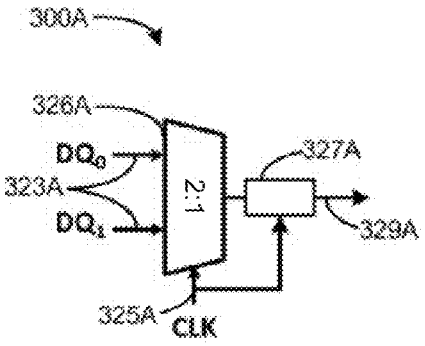
FIG. 3A is a block diagram of a system including a parallel-to-serial converter according to an example.

FIG. 3A is a block diagram of a system 300A including a parallel-to-serial converter 326A according to an example. A data storage element (e.g., latch, flip-flop, etc.) 327A is coupled to receive output from parallel-to-serial converter 326A. The parallel-to-serial converter 326A is to receive inputs 323A (DQ0, DQ1) and clock 235A (CLK), and provide output 329A.

System 300A may be used as a serializer, e.g., in a first module of system 100 shown in FIG. 1. The parallel-to-serial converter 326A is a 2:1 parallel-to-serial converter, to time division multiplex two inputs 323A to/from a single output 329A. The data storage element 327A enables system 300A to hold the output 329A, enabling system 300A to be cascaded with other systems to form a parallel-to-serial converter having a greater number of inputs 323A.

In an example, the multiple inputs 323A may be provided as differential input data paths that are to have one or more output path(s). The input/output may be determined by positive or negative values of a clock 235A. In an example of the 2:1 parallel-to-serial converter system 300A, a value of the output 329A may be determined by rising and falling edges of the clock 325A. The input 323A may be associated with bits that are input and sampled at a logical high of the clock 325A. The parallel-to-serial converter 326A may pass output at logical lows of the clock 325A. The system 300A may be associated with a propagation delay ($t_D$) between the inputs 323A and the output of the 2:1 parallel-to-serial converter. The data storage element 327A may temporarily store the data, acting as a buffer and to synchronize the output.

Figure 3C:
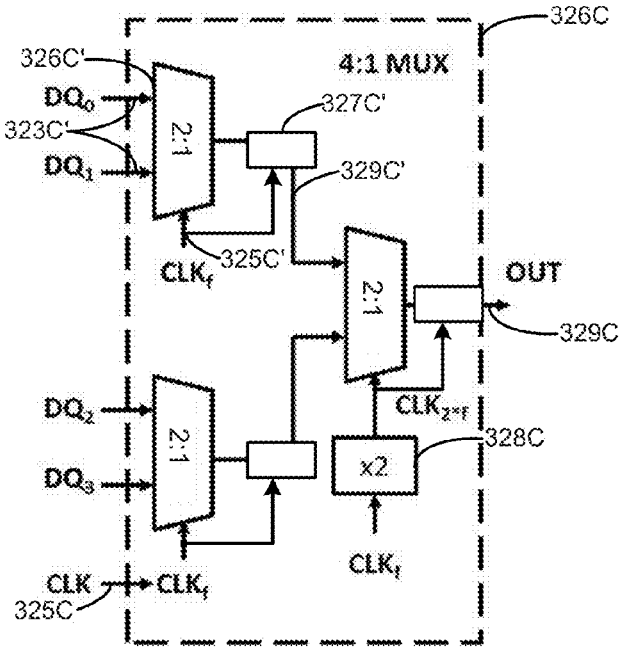
FIG. 3C is a block diagram of a parallel-to-serial converter according to an example.
Figure 3B:
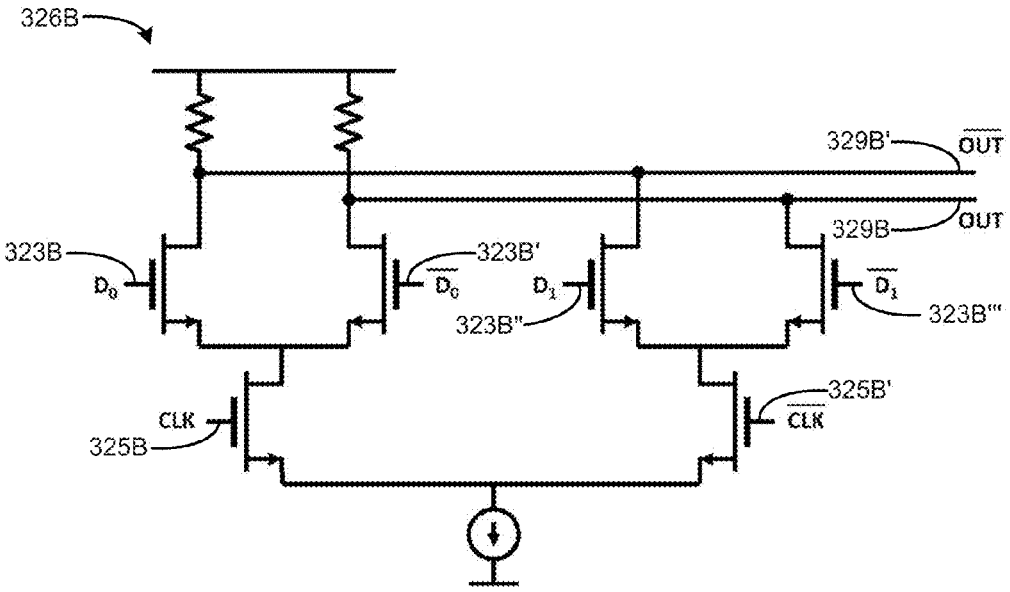
FIG. 3B is a block diagram of a parallel-to-serial converter according to an example.

FIG. 3B is a block diagram of a parallel-to-serial converter 326B according to an example. Parallel-to-serial converter 3263 includes a plurality of transistors to receive first input 323B (D0) and a complement first input 323B' ($\overline{D0}$), second input 323B" (D1) and a complement second input 323B'" ($\overline{D1}$), and clock 325B (CLK) and a complement clock 325B' ($\overline{CLK}$). Parallel-to-serial converter 326B is to provide output 329B (OUT) and a complement output 329B' ($\overline{OUT}$).

The parallel-to-serial converter 326B illustrates differential inputs and output (e.g., using an input/output/clock, and their corresponding complements). Thus, the parallel-to-serial converter 326B may function as a 2:1 parallel-to-serial converter (e.g., as the 2:1 parallel-to-serial converter 326A of FIG. 3A) based on two inputs and one output, although additional signals are shown due to the differential aspects. A differential output is shown, by providing two output signals per output 329B (OUT) and complement output 329B' ($\overline{OUT}$). In an alternate example, the parallel-to-serial converter 326B may provide a single-ended output. For example complement output 329B' ($\overline{OUT}$) may be omitted by removing the output signal line emerging from the node shared with the drain of the transistor to receive second input 323B" (D1). Other transistor level parallel-to-serial converter topologies employing pass transistor logic, etc. may be employed, and are omitted for brevity. In an alternate example, FIG. 3B may be implemented based on complementary pass transistors to create reciprocal parallel-to-serial or serial-to-parallel functionality, as appropriate.

FIG. 3C is a block diagram of a parallel-to-serial converter according to an example. Parallel-to-serial converter 326C includes a plurality of 2:1 parallel-to-serial converters 326C' in a cascade configuration, to provide output 329C of parallel-to-serial converter 326C based on inputs 323C' (DQ0, DQ1, DQ2, DQ3) and clock 325C (CLK). A 2:1 parallel-to-serial converter 326C' is coupled to a data storage element 327C', to provide stored output 329C' based on the inputs 323C' and clock 325C'. The latched output 329C' is cascaded as input into the output 2:1 parallel-to-serial converter at the top of the cascade. Parallel-to-serial converter 326C also includes a doubler 328C, to double a frequency of the clock signal ($CLK_f$) to provide a doubled clock signal to the output 2:1 parallel-to-serial converter.

Parallel-to-serial converter 326C illustrates a 4:1 parallel-to-serial converter formed by three 2:1 parallel-to-serial converters (such as the 2:1 parallel-to-serial converter of FIGS. 3A and 3B). The data storage element 327C' enables the cascade arrangement to accommodate propagation delays associated with the individual components, or otherwise synchronize the paths of the parallel-to-serial converter 326C. A data storage element may be a latch, a flip-flop or other element/component that stores data. A period of the input clock 325C may be multiplied in a second stage of the 2:1 parallel-to-serial converter, e.g., based on doubler 328C. Similarly, subsequent cascades may be used to realize an 8:1 parallel-to-serial converter or other parallel-to-serial converter configurations. As such, a clock frequency at the last stage of the parallel-to-serial converter is typically F/2*N, where F is the frequency of the data input and N is the input of channels.

A tree configuration of a parallel-to-serial converter is illustrated in FIG. 3C, although other example parallel-to-serial converter configurations are possible. The parallel-to-serial converter 326C may serve as a component in a serializer module, such as the first module 120 in FIG. 1. The parallel-to-serial converter 326C may have a pre-emphasis circuit/module to follow the parallel-to-serial converter, which also may form a part of the serializer or simply called a MUX. The pre-emphasis circuit may be expressed as a finite impulse response (FIR) transmitter architecture. The parallel-to-serial converter clocking scheme may additionally be half-rate, quarter rate, and so on. The various clock signals may be varied, in that a clock signal may be delayed by, e.g., 180 degrees for a half-rate, and the clock signal may be delayed by 90 degrees for a quarter-rate, and so on. Examples may be based on the same clock frequency, while using various phase-shifted clock signals.

Figure 4A:
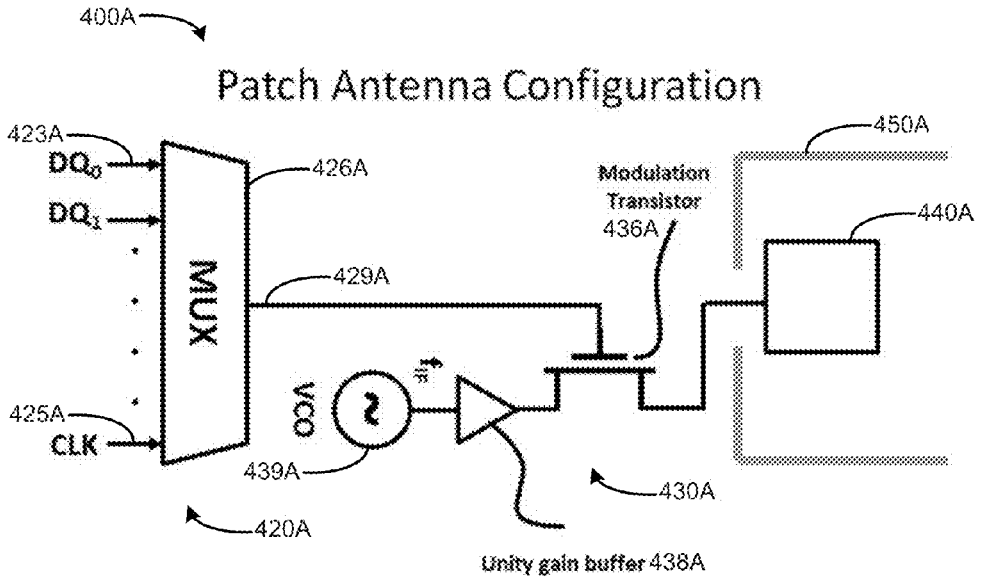
FIG. 4A is a block diagram of a system including an antenna, modulation transistor, voltage controlled oscillator and serializer according to an example.

FIG. 4A is a block diagram of a system 400A including an antenna 440A, modulation transistor 436A, voltage controlled oscillator 439A and serializer 426A according to an example. The system 400A also includes first module 420A and second module 430A. The first module 420A is to serialize data, and includes MUX 426A. The MUX 426A may be operated to time division multiplex inputs 423A (DQ0, DQ1, . . . ) based on clock 425A to provide output 429A. The second module 430A is to up-convert data, and includes an oscillator 439A coupled to a buffer 438A coupled to a transistor 436A. The components of the second module 430A are arranged to receive the output 429A as input, and up-convert the time division multiplexed data based on the oscillator 439A. A matching network may be incorporated between the 436A and 440 to minimize reflections. In an alternate example, system 400A may include a plurality of components to cause the second module 430A to up-convert as desired. The second module 430A is coupled to a HMWG 450A and antenna 440A.

System 400A may use a common-gate configuration. For example, a gate of the transistor 436A may serve as a signal modulator. A source of the transistor 436A may be tied to an output of the oscillator 439A (e.g., via buffer 438A). A drain of the transistor 436A may feed into the antenna 440A (e.g., a patch antenna) for a single-ended configuration.

The oscillator 439A may drive radiated power for the second module 430A and the system 400A. A frequency of the oscillator 439A ($f_{IF}$) may be generated based on a variable controlled oscillator (VCO) implementation, although examples are not so limited, and may be based on other configurations such as a ring oscillator, an inductor-capacitor (LC) tank oscillator, and so on.

The buffer 438A may be omitted and is optional. The optional buffer 438A may be a unity gain buffer, which may be operated to improve impedance control (e.g., buffer the signal) between the oscillator 439A and the transistor 436A. Thus, buffer 438A may avoid significant changes to the impedance, as seen from the oscillator 439A into the source of the transistor 436A, e.g., when the transistor 436A is transitioning on or off. An example unity gain buffer 438A may be realized using a source-follower configuration. In another example, the unity gain buffer 438A may be realized using an inverter.

A coupling between the antenna 440A and waveguide 450A is illustrated schematically, wherein the waveguide 450A can partially enclose and/or envelop the antenna 440A. More specifically, system 400A may include VCO 439A, modulation transistor 436A, MUX 426A and buffer 438A fabricated on a silicon substrate through a CMOS process, such that the rectangular, hollow waveguide 450A may include elbows that overlap the antenna 440A. Thus, the antenna 440A may have a radiation pattern that is predefined, to excite a fundamental transverse electric mode of the waveguide 450A based on the positioning of the antenna 440A within the waveguide 450A, such that the excited mode may propagate down the hollow waveguide 450A.

Figure 4B:
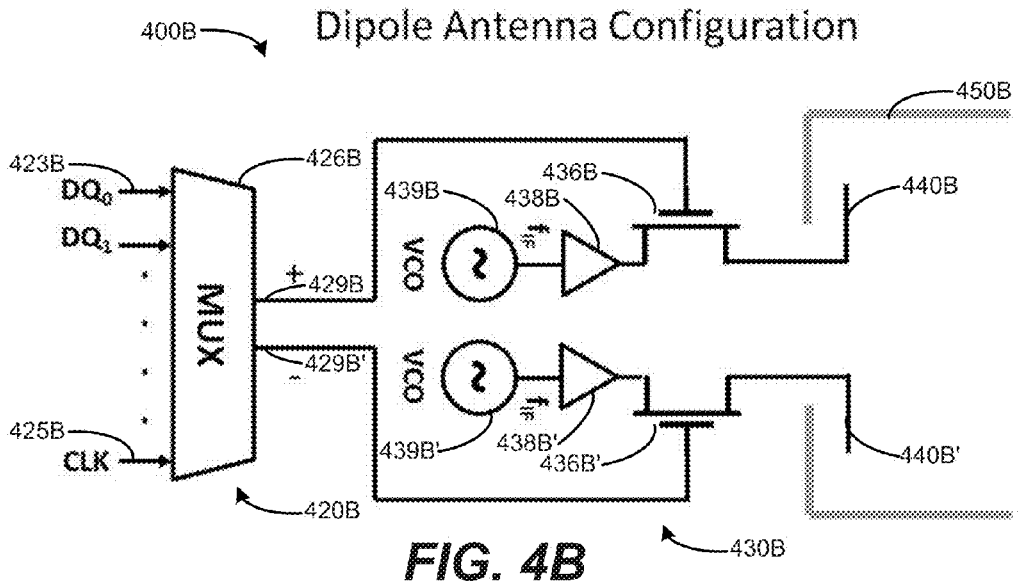
FIG. 4B is a block diagram of a system including an antenna, modulation transistor, voltage controlled oscillator and serializer according to an example.

FIG. 4B is a block diagram of a system 400B including an antenna 440B, 440B, modulation transistor 436B, 436B', voltage controlled oscillator 439B, 439B' and serializer 426B according to an example. The system 400B also includes first module 420B and second module 430B. The first module 420B is to serialize data, and includes MUX 426B. The MUX 426A may be operated to time division multiplex inputs 423B (DQ0, DQ1, . . . ) based on clock 425B, to provide differential output 429B, 429B'. The second module 430B is to up-convert data, and includes paired complementary components to provide differential signals for a dipole antenna configuration. A first set of components includes an oscillator 439B coupled to a buffer 438B coupled to a transistor 436B, to interface with antenna 440B. A second set of complementary components 439B', 438B', and 436B' are similarly arranged, to interface with antenna 440B'. The components of the second module 430B are arranged to receive the output 429B, 429B' as input, and up-convert the time division multiplexed data based on the oscillators 439B, 439B'. In an alternate example, the components may be arranged to receive, as input, signals from the antenna 440B, 440B', and down-convert those signals based on the oscillators 439B, 439B' to provide output 429B, 429B' to the MUX 426B. In an alternate example, system 400B may include a plurality of components to cause the second module 430B to up-convert and/or down-convert as desired, e.g., based on switching between receiver/transmitter functionality. The second module 430B is coupled to HMWG 450B and antennas 440B, 440B'.

The antennas 440B, 440B' may include a dipole antenna (e.g., a bowtie antenna), such that a differential signal 429B, 429B' coming out of the first module 420B (a serializer) may enable a positive line connected to a gate of the transistor 436B to act as a signal modulator. A source of the transistor 436B may be tied to the output of the oscillator 439B, and a drain of the transistor 436B may feed into one arm of the dipole antenna 440B. A matching network may be incorporated between the 436B/436B' and 440B/440B' to minimize reflections. Similarly, a negative line (output 429B' from the first module 420B) may be connected to a gate of another transistor 436B' to act as a secondary and synchronous signal modulator. Thus, the source of transistor 436B' may be tied to output of another oscillator 439B' (effectively doubling the output power), and the drain of transistor 436B' may feed into the other arm of the dipole antenna 440B'. The two paths may be designed to ensure proper phase matching for a proper dipole radiation pattern from the antenna 440B, 440B'.

System 400B may operate as a transmitter circuit having a serializer first module 420B, that drives into two legs of a dipole antenna 440B, 440B'. Thus, system 400B may take advantage of dual-oscillator configuration where it is easier to generate mm wave frequency power as oppose to an inline amplifier. The two legs of the dipole system may be designed for proper phase matching. Thus, examples may be compatible with serial data that uses differential pair routing/traces that go into a mixer differentially. Depending on a mixer configuration, the data may come out differentially or single ended, depending subsequent circuitry. In an alternate example, e.g., using a patch antenna, a differential-to-single-ended output stage may be used at an end of the serializer first module 420B, so that data going into the modulation transistor is single ended. In an alternate example, half of the system 400B may be selectively disabled for using one remaining leg of the antenna (e.g., as in FIG. 4A). Depending on the antenna output, examples may selectively determine (e.g., based on switching) whether to drive one or both legs of an antenna. FIGS. 4A and 4B further illustrate the benefit of using an oscillator to drive radiated power, in contrast to using an amplifier or other driver.

Figure 4C:
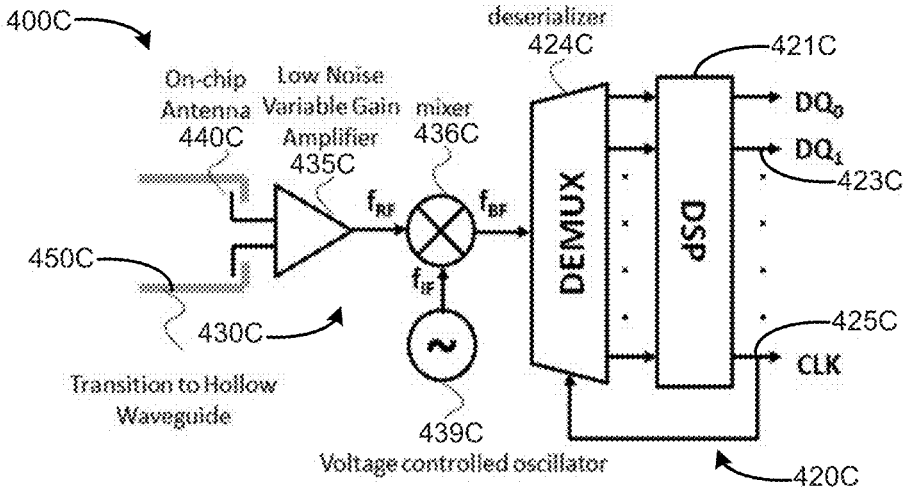
FIG. 4C is a block diagram of a system including an antenna, gain amplifier, mixer, voltage controlled oscillator, de-serializer and digital signal processor (DSP) according to an example.

FIG. 4C is a block diagram of a system 400C including an amplifier 435C, mixer 436C, VCO 439C, deserializer 424C, and digital signal processor (DSP) 421C according to an example. System 400C also includes second module 430C and first module 420C. Antenna 440C is coupled to the waveguide 450C and the variable gain amplifier 435C. The amplifier 435C is to provide output $f_{RF}$ as input to the mixer 436C. The mixer 436C also is to receive $f_{IF}$ as input from the oscillator 439C. The mixer 436C is to provide output $f_{BF}$ as input to the de-serializer 424C, which is coupled to the DSP 421C and clock 425C. The DSP 421C is to provide outputs 423C (DQ0, DQ1, . . . ). A matching network may be incorporated between the on-chip antenna 440C to the amplifier 435C or between the amplifier 435C to mixer 436C or between VCO 439C to mixer 436C or between mixer 436C to deserializer 424C to minimize reflections.

System 400C illustrates a general receiver architecture, which may be based on a differential antenna (e.g., dipole) configuration as illustrates. In an example, the output $f_{RF}$ of the low noise variable gain amplifier 435C may be provided as a differential output to be fed into a differential mixer 436C. Alternatively, output $f_{RF}$ of the amplifier 435C may be provided as a single ended output to be fed into a single ended mixer 436C. Thus, the receiver system 400C may be provided as an example based on the first module 420C, second module 430C, and antenna 440C general architecture as shown in FIG. 1. System 400C accordingly may receive information from the waveguide 450C, and down-convert and de-serialize the received information to provide data signals at the output 423C and/or clock 425C.

Figure 4D:
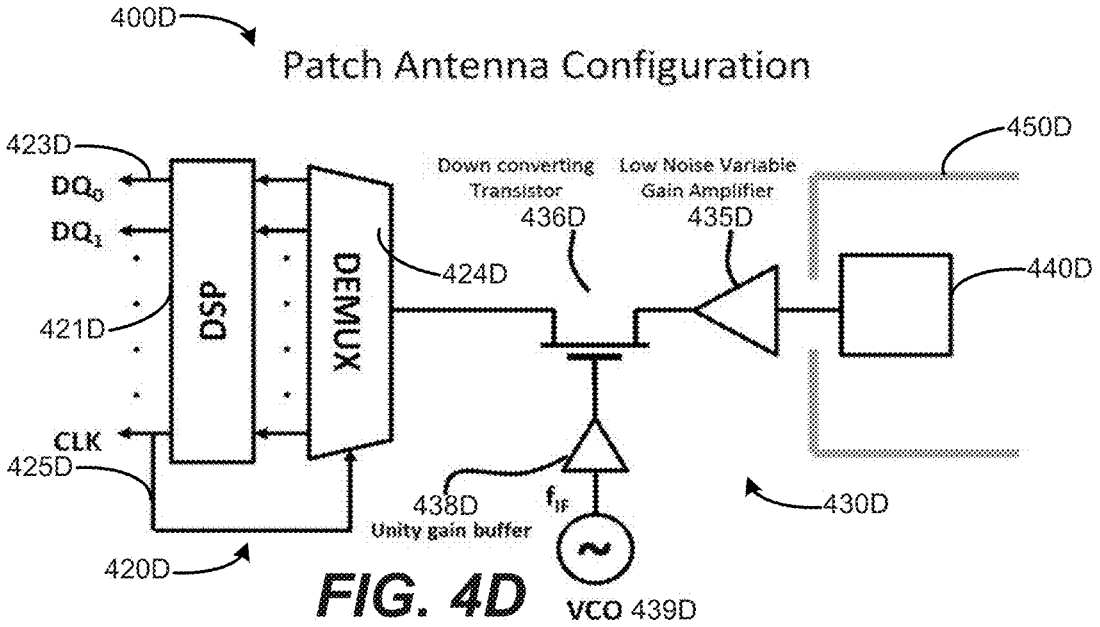
FIG. 4D is a block diagram of a system including an antenna, gain amplifier, down converting transistor, voltage controlled oscillator, de-serializer and DSP according to an example.

FIG. 4D is a block diagram of a system 400D including an amplifier 435D, down converting transistor 436D, VCO 439D, deserializer 424D, and DSP 421D according to an example. System 400*d* also includes first module 420D and second module 430D. Antenna 440D is coupled to the waveguide 450D and the amplifier 435D. The amplifier 435D is coupled to the transistor 436D. The transistor 436D also is to receive $f_{IF}$ as input from the oscillator 439D, via the buffer 438D. The transistor 436D also is coupled to the de-serializer 424D, which is coupled to the DSP 421D and clock 425D. The DSP 421D is to provide outputs 423D (DQ0, DQ1, . . . ). A matching network may be incorporated between the on-chip antenna 440D to the amplifier 435D or between the amplifier 435D to mixer 436D or between VCO 439D to down converting transistor 436D or between down converting transistor 436D to deserializer 424D to minimize reflections.

System 400D is to operate as a receiver, and also may be provided as an example based on the first module 420D, second module 430D, and antenna 440D general architecture as shown in FIG. 1. More specifically, the patch antenna configuration receiver architecture of system 400D may include a patch antenna 440D, followed by a low-noise variable gain amplifier 435D that is to feed into a source of the down-converting transistor 436D. The oscillator 439D may be tied to a gate of the transistor 436D, to switch the transistor 436D to down-convert the amplified data received by the antenna 440D. The received data may be down-converted to, e.g., a baseband frequency ($f_{BF}$) provided at the drain of the transistor 436D, to be fed into a DEMUX de-serializer 424D. In an example, the DEMUX 424D and DSP 421D may include a continuous time linear equalizer (CTLE) followed by a clock data recovery (CDR) circuit (used to recover the CLK signal typically embedded in the data stream), and a digitally tunable equalizer followed by a serial-to-parallel converter to output digital information (such as DQ0, DQ1, . . . , CLK). One example configuration of such components (including CTLE, CDR, digitally tunable equalizer, and serial-to-parallel converter circuits, and so on) is disclosed, although other arrangements may be used to provide the described features and functionality described throughout the specification.

Figure 4E:
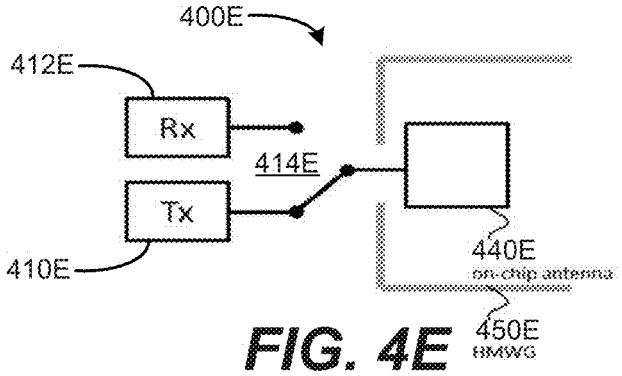
FIG. 4E is a block diagram of a system including a switch according to an example.

FIG. 4E is a block diagram of a system 400E including a switch 414E according to an example. The switch 414E is coupled to the antenna 440E, which is coupled to the waveguide 450E. The switch 414E is to selectively couple the antenna 440E to the receiver 412E or the transmitter 410E. A matching network may be incorporated between the switch 414E and the on-chip antenna 440E.

The receiver 412E and the transmitter 410E may represent various modules presented throughout the disclosure, such as system 400D of FIG. 4D and system 400A of FIG. 4A. In an example, the receiver 412E and the transmitter 410E may have slightly different circuit arrangements, to customize the up-converting or down-converting behavior provided therein. Accordingly, switch 414E enables a single antenna 440E to be used, by connecting the antenna 440E as needed to either the receiver 412E or the transmitter 410E. In an example, the switch 414E may prevent the antenna from being connected to both the receiver 412E and the transmitter 410E simultaneously. In an alternate example, the switch 414E may be connectable to neither or both the receiver 412E and the transmitter 410E simultaneously.

Figure 5A:
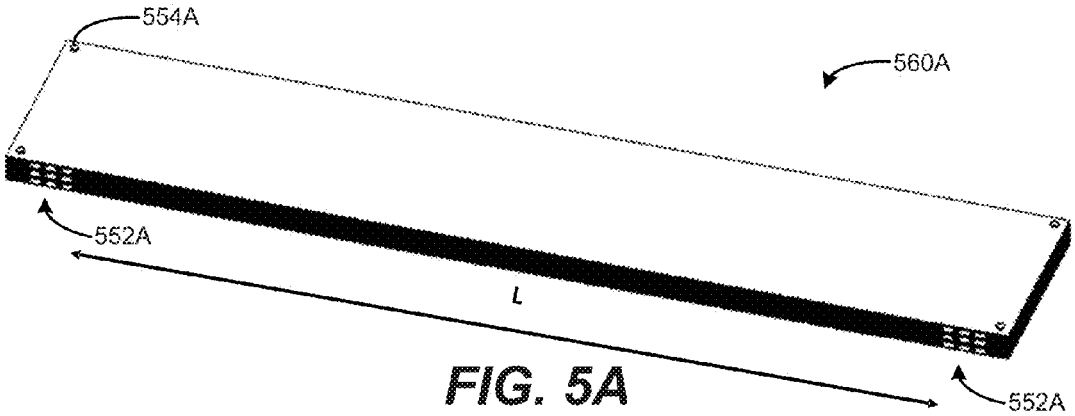
FIG. 5A is a perspective view of a backplane including a port according to an example.

FIG. 5A is a perspective view of a backplane 560A including a port 552A according to an example. Backplane 560A may include a plurality of ports 552A to communicate with corresponding HMWGs within the backplane 560A. The ports 552A may be grouped, and separated from each other by a distance L corresponding to the backplane 560A.

The backplane 560A may be assembled based on at least one guide pin 554A. Nine channel ports are shown in a 3×3 configuration.

The length L of the backplane 560A is not drawn to scale. Backplane 560A may have a length of, e.g., at least 0.1 meter, and may be up to 3 meters or more in length. Generally, the backplane 560A may be based on a hollow metallic waveguide (HMWG) operating at millimeter wave frequencies, and driven by CMOS technology. More specifically, the example backplane 560A includes 2×(3×3) channels, as shown by the grouping of ports 552A at opposite ends of the channels (including a corresponding set of ports, not visible, that would emerge from a back side of the backplane 560A). The backplane 560A may be assembled/constructed out of aluminum (or other materials compatible with waveguide functionality). The number of channels/ports 552A may be scalable with application. Similarly, the number of corresponding transceiver/transmitter/receiver modules (e.g., as shown in FIG. 1) to interface with and communicate via the waveguide channels are scalable. A point-to-point architecture is illustrated for simplicity. In practice, multitap architectures may be employed, that may use power splitters (not illustrated) in combinations such as 50:50, 90:10 and others. The guide pins 554A are to align multiple layers together, including multiple layers of patterned metal.

As system frequencies (e.g., used by system interfacing with the backplane 560A) increase into the millimeter regime (30-3000 GHz), waveguide sizes, and corresponding backplane 560A based on such waveguides, also may decrease due to the decreasing wavelengths. With the increasing performance of CMOS technologies operating in the millimeter frequencies used to interface systems with the backplane 560A, arrangements of these hollow waveguides may be employed as compact, backplane architectures and an alternative to optical backplanes.

Such backplanes 560A based on hollow metallic waveguides operating at millimeter wave frequencies driven by CMOS technology enable various benefits. For example, backplane 560A may enable lower costs in construction, and provide mechanically robust construction. For example, backplane 560A may be constructed of metals or plastic molding and modified by sputtering/electroplating/etc. Backplane 560A may enable highly serial transmissions for high data rate applications (e.g., over 40 Gbs). Backplane 560A may be driven by low cost CMOS technology, in contrast to optical wavelengths driven by optical sources such as vertical-cavity surface-emitting lasers (VSCELs), distributed feedback lasers (DFBs), light-emitting diodes (LEDs), and other sources that may rely on complicated MEMS switches, taps, alignments, packaging, etc. The backplane 560A is scalable to higher data rates, due to higher operating frequencies, corresponding to increasing performance of CMOS and smaller waveguide form factors with decreasing wavelengths. Additionally, backplane 560A may provide zero crosstalk between adjacent channels, ensuring robust channel isolation.

Figure 5B:
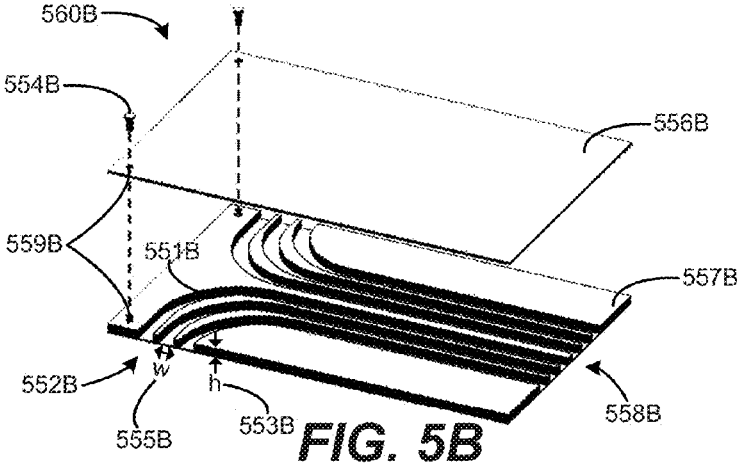
FIG. 5B is a partial perspective view of a backplane including a channel according to an example.

FIG. 5B is a partial perspective view of a backplane 560B including a channel 558B according to an example. A plurality of channels 558B are shown, and a channel 558B may correspond to a waveguide within the backplane 560B. A channel 558B may be associated with a height 553B and width 555B, and may include a curved bend 551B. A channel 558B is shown meeting a side of the backplane 560B at a port 552B. The backplane 560B is shown assembled from an enclosure plate 556B and patterned hollow waveguide plate 557B, based on a guide pin 554B and an alignment hole 559B. Six channels are shown. FIG. 5B may correspond to a first portion of a full backplane, e.g., an end portion of the backplane 560A of FIG. 5A.

The 2×(1×3) channels 558B of the backplane 560B may be milled out of an aluminum plate with specific dimensions of width (w) and height (h). Other methods may be used to construct the patterned hollow waveguide plate, including electro discharge machining (EDM), creating a plastic replica mold from a deep reactive-ion etching (DRIE) micromachined master mold or deep-ultraviolet (UV) lithography, etc., followed by sputtering and electroplating, etc. Thus, construction is not limited to traditional milling/machining of the hollow waveguides. The enclosure plate(s) and patterned hollow waveguide plate(s) may be bonded to each other using diffusion bonding, eutectic bonding, etc., to provide a reliable channel for waveguide propagation. In an example, the width w 555B of a rectangular waveguide may be between approximately 34 to 224 mil, and the height h 553B may be between approximately 17 to 112 mil. In an example, the waveguide dimensions may correspond to Internal Band Designations WR 22.4, 18.8, 14.8, 12.2, 10.0, 8.0, 6.5, 4.3 and 3.4 for fundamental mode ($TE_{10}$) propagation, corresponding to operating in mm wave frequency bands as defined to be 33 GHz to 330 GHz. Guiding pin holes 559B may be used for multilayer alignment during the construction of the backplane 560B. Additionally, an H-bend 551B is employed to ensure a smooth transition from the input to the backplane. A number of channels which can be propagated through a single layer is not limited to the illustrated 2×(1×3) configuration, and other configurations are possible. To align multilayer layers of enclosure plate(s) and patterned hollow waveguide plate(s), guide pins 554B and alignment holes 559B may be employed to minimize misalignment and enable efficient construction.

Multiple bends are shown, and 2 or more bends may be used to form the backplane 560B. The construction of the metal plates enables forming a type of port array, that may serve as a platform for a backplane 560B. In an example, systems to interface with backplane 560B (e.g., line cards) may be stacked/inserted/coupled to the backplane 560B, e.g., 8 line cards, 4 on each side, to form a mesh architecture or other topology. An example mesh architecture of a 4-port backplane 560B may be configured such that port 1 would be connected to ports 2, 3, and 4. For example, one lane may be connected from port 1 to port 2, another lane connected from port 1 to port 3, and another from port 1 to port 4. Port 2 may be connected to ports 3 and 4, and port 3 may be connected to port 4, forming a mesh architecture by which a port is connected to every other port. A mesh architecture backplane 560B may be well-suited for a redundant system, such as a storage networks. However, other architectures are possible.

In an example, at least two bends may be used to couple the energy from one port to another port. A bend may provide a smooth transition from one direction to another, based on a bend radius of, e.g., more than a half inch (e.g., more than 12.7 mm). Smooth bends enable propagation waves to be fundamental without mode distortion during the bend, and no reflections, e.g., as compared to a 90-degree elbow junction bend that incurs reflections at the junction. A bend 551B may have a constant width and/or height throughout the bend, and may have a constant radius throughout the bend.

In an example, a height h 553B of a channel may be approximately half of the width w 555B. The width w 555B and height h 553B may be used to determine a cutoff frequency for a channel and/or backplane 560B. Thus, dimensions of the backplane 560B may be chosen to enable usable frequencies above a cutoff frequency, and below frequencies at which higher order modes may propagate along the hollow waveguide, enabling usable bandwidth of each channel 558B of the backplane 560B.

At mm wave frequencies, multiple waveguides can be arranged into arrays to form the backplane 560B. Multitap architecture backplanes 560B may use power splitters/combiners, such as broadside splitters and septum splitters, including other configurations. A broadside configuration may include a through-line and another line (e.g., a couple line), with a shim between them having apertures to allow coupling. A magnitude of the coupling may be determined by a size and number of the apertures. Various couplings may be enabled between the channels 558B of the backplane 560B, enabling various power coupling ratios such as coupling out 10% of the power, and passing through 90% of the power at each coupling. Other ratios may be used, such as a 95-5, where 95% of the power is allowed to pass through the line, and 5% is coupled out at each coupling. Various configurations are possible to enable a multitap backplane. Thus, a line card may be inserted one side of the backplane 560B to interface with a port 552B, and another line card may be inserted on another side of the backplane 560B to interface with other ports on the waveguide 560B and communicate through the network of channels 558B.

Figure 5C:
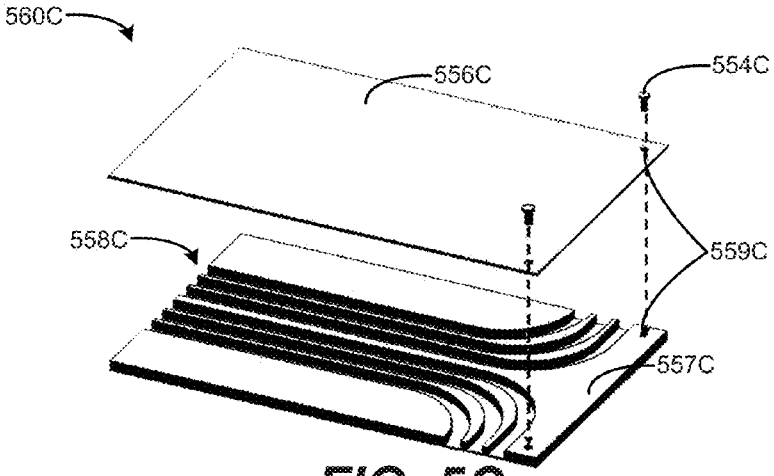
FIG. 5C is a partial perspective view of a backplane including a channel according to an example.

FIG. 5C is a partial perspective view of a backplane 560C including a channel 558C according to an example. The backplane 560C also includes an enclosure plate 556C assembled with a patterned hollow waveguide plate 557C based on a guide pin 554C and an alignment hole 559C. Six channels are shown, corresponding to the six channels of FIG. 5B. FIG. 5C may correspond to a second portion of a full backplane, e.g., an end portion of the backplane 560A of FIG. 5A. A length of the channels 558C may be extended as needed, and dimensions are not shown to scale.

Figure 6A:
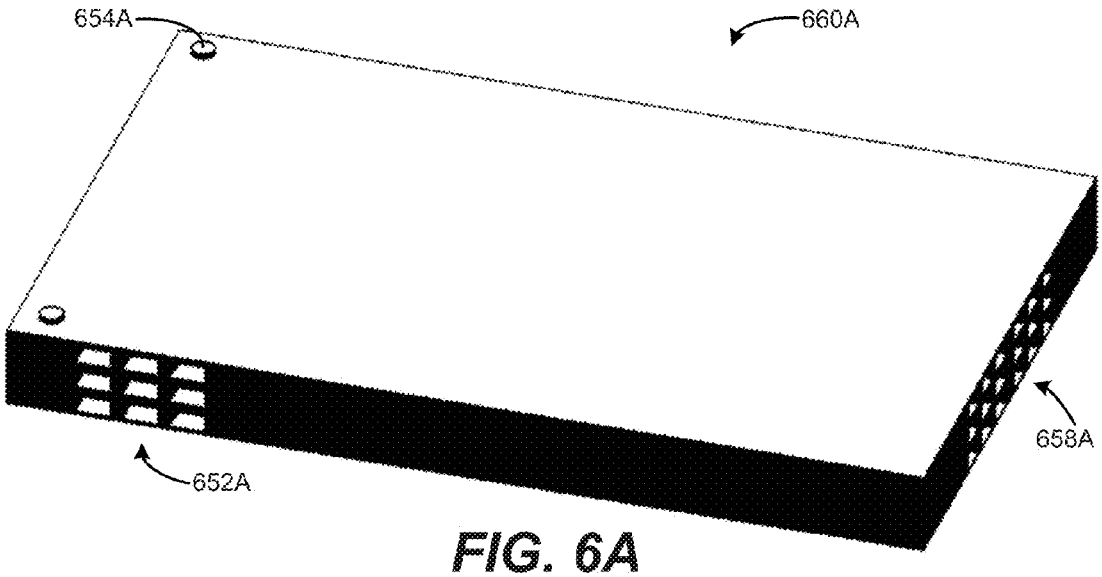
FIG. 6A is a partial perspective view of a backplane including a port according to an example.

FIG. 6A is a partial perspective view of a backplane 660A including a port 652A according to an example. The backplane 660A also includes a guide pin 654A and a channel 658A. Nine ports are shown, and eighteen channels are shown (corresponding to the nine ports shown and an additional nine ports not visible along the back side of the backplane 660A). FIG. 6A may correspond to a first portion of a full backplane, e.g., an end portion of the backplane 560A of FIG. 5A. FIG. 6A also illustrates the feature of layer stacking to provide layers of channels.

FIG. 6A provides an illustration of three layers of enclosure plates, and patterned hollow waveguide plates, assembled together with guide pins to form a 2×(3×3) backplane with layers of channels 658A. A second set of ports 652A are not visible, arranged on a back side of the backplane 660A, and corresponding to the second set of channels 658A shown emerging from a side of the backplane 660A.

Figure 6B:
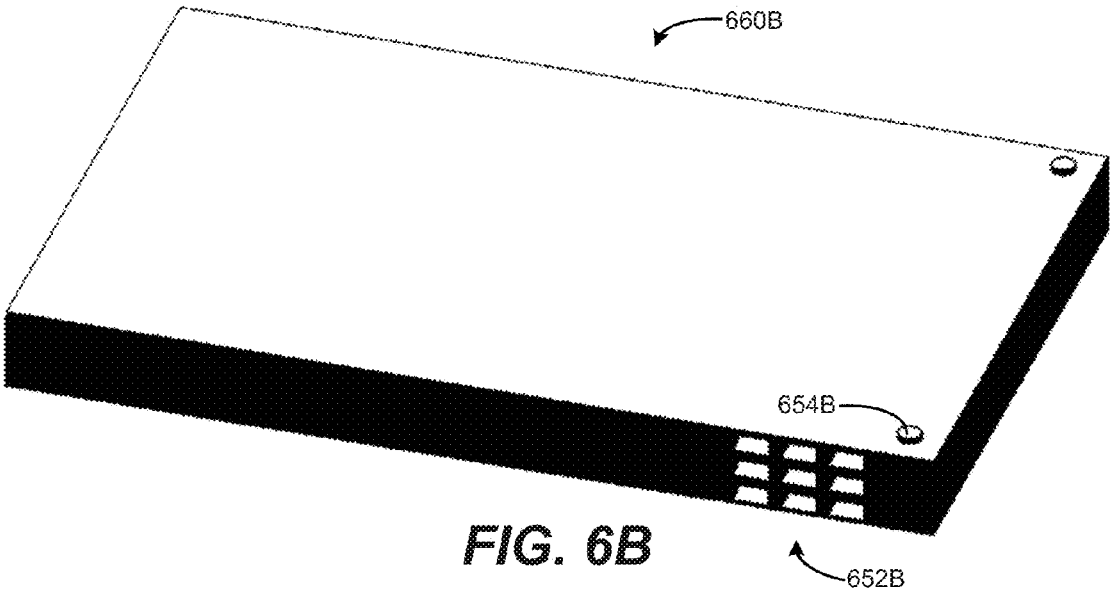
FIG. 6B is a partial perspective view of a backplane including a port according to an example.

FIG. 6B is a partial perspective view of a backplane 660B including a port 652B according to an example. The backplane 660B also includes a guide pin 654B and a channel (not shown). Nine ports are shown, corresponding to the nine ports in FIG. 6A. FIG. 6B may correspond to a second portion of a full backplane, e.g., an end portion of the backplane 560A of FIG. 5A. The backplane 660B may include a second set of ports that are not visible, arranged on a back side of the backplane 660B, and corresponding to the second set of channels 658A in FIG. 6A shown emerging from a side of the backplane 660A.

What is claimed is:

1. A system comprising:

a first module formed on a complementary metal-oxide-semiconductor (CMOS) chip substrate to serialize and de-serialize a data signal;

a second module formed on the CMOS chip substrate coupled to the first module to up-convert and down-convert the data signal to and from the first module;

an antenna coupled to the second module and integrated onto the CMOS chip substrate, to transmit and receive the data signal to and from the second module at millimeter wave frequencies; and a plurality of hollow metal waveguides (HMWGs) coupled to the antenna, the plurality of HMWGs forming a backplane;

wherein the first and second modules are arranged for proximity to the antenna to avoid substantially degrading the data signal at millimeter wave frequencies in migrating the data signal between the first module and the antenna; and wherein the backplane includes a plurality of ports separated into groups at opposite ends along a length of the backplane and emerging from a side of the backplane, and wherein a given group is formed by a two-dimensional array of ports.

2. The system of claim 1, wherein the plurality of waveguides are to provide a mesh architecture.

3. The system of claim 1, wherein the backplane comprises a plurality of metal plates to enclose the plurality of waveguides.

4. The system of claim 1, wherein the backplane includes at least two bends associated with a bend radius for fundamental transfer selection mode propagation at millimeter wave frequencies without causing mode distortion or reflections.

5. The system of claim 4, wherein the bend radius is at least 12.7 millimeters.

6. The system of claim 1, wherein the backplane is multitap based on at least one power splitter.

7. The system of claim 1, wherein the antenna is based on metal or metal alloy.

8. The system of claim 1, wherein the antenna is planar.

9. The system of claim 1, wherein the antenna is a dipole antenna;

wherein the second module includes a first transistor to act as a signal modulator, having a first gate associated with receiving a positive line of a differential data signal, a first source coupled to a first oscillator, and a first drain fed into a first arm of the dipole antenna;

wherein the second module includes a second transistor serving as a secondary synchronous signal modulator, having a second gate associated with a negative line of the differential data signal, a second source coupled to a second oscillator, and a second drain fed into a second arm of the dipole antenna; and wherein the first and second transistors provide paths having phase matching for a proper dipole radiation pattern.

10. The system of claim 1, wherein the antenna is a monopole antenna; and the second module includes a transistor having a common gate configuration, wherein a gate is to serve as a signal modulator, a source is tied to an oscillator, and a drain is to feed into the monopole antenna for a single-ended configuration.

11. A system comprising:

a first module formed on a complementary metal-oxide-semiconductor (CMOS) chip substrate to serialize and de-serialize a data signal;

a second module formed on the CMOS chip substrate coupled to the first module to up-convert and down-convert the data signal to and from the first module;

an antenna coupled to the second module and integrated onto the CMOS chip substrate, to transmit and receive the data signal to and from the second module at millimeter wave frequencies, wherein the antenna is coupleable to a hollow metal waveguide (HMWG); and a plurality of HMWGs enclosed by a plurality of metal plates to provide a backplane coupled to the antenna;

wherein the first and second modules are arranged for proximity to the antenna to avoid substantially degrading the data signal at millimeter wave frequencies in migrating the data signal between the first module and the antenna; and wherein the backplane includes a plurality of ports separated into groups at opposite ends along a length of the backplane and emerging from a side of the backplane, and wherein a given group is formed by a two-dimensional array of ports.

12. A system comprising:

a transmitter formed on a complementary metal-oxide-semiconductor (CMOS) transmitter chip substrate to serialize and up-convert a data signal, including a transmitter antenna integrated onto the CMOS transmitter chip substrate, to transmit the data signal and avoid substantially degrading the data signal at millimeter wave frequencies in migrating the data signal across the transmitter to the transmitter antenna;

a plurality of hollow metal waveguides (HMWGs) enclosed by a plurality of metal plates to provide a backplane, wherein a given one of the plurality of HMWGs is coupled to receive the data signal at millimeter wave frequencies from the transmitter antenna; and a receiver formed on a CMOS receiver chip substrate to down-convert and de-serialize the data signal, including a receiver antenna integrated onto the CMOS receiver chip substrate based on techniques compatible with CMOS processing, coupled to the HMWG to receive the data signal and avoid substantially degrading the data signal at millimeter wave frequencies in migrating the data signal across the receiver; and wherein the backplane includes a plurality of ports separated into groups at opposite ends along a length of the backplane and emerging from a side of the backplane, and wherein a given group is formed by a two-dimensional array of ports.

13. The system of claim 12, wherein the HMWG includes at least two bends to provide fundamental transfer selection mode propagation at millimeter wave frequencies between the transmitter antenna and the receiver antenna, without causing mode distortion or reflections.

* * * * *